US010876340B2

(12) United States Patent
Rupp et al.

(10) Patent No.: US 10,876,340 B2
(45) Date of Patent: Dec. 29, 2020

(54) GUIDE SYSTEM FOR GUIDING A MOVABLY MOUNTED FURNITURE PART

(71) Applicant: Julius Blum GmbH, Hoechst (AT)

(72) Inventors: Matthias Rupp, Hohenweiler (AT); Christian Hauer, Hoerbranz (AT); Hermann Haemmerle, Lustenau (AT); Ingo Gasser, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/509,011

(22) Filed: Jul. 11, 2019

(65) Prior Publication Data

US 2019/0330896 A1 Oct. 31, 2019

Related U.S. Application Data

(63) Continuation of application No. PCT/AT2017/060348, filed on Dec. 22, 2017.

(30) Foreign Application Priority Data

Jan. 13, 2017 (AT) ..... 50024/2017

(51) Int. Cl.
*E05D 15/00* (2006.01)
*E05D 15/26* (2006.01)
(Continued)

(52) U.S. Cl.
CPC ..... *E05D 15/264* (2013.01); *E05D 15/36* (2013.01); *E05D 15/58* (2013.01); *E06B 3/482* (2013.01); *E05Y 2900/212* (2013.01)

(58) Field of Classification Search
CPC ..... E05Y 2900/212; E05D 15/264; E05D 15/36; E05D 15/58; E06B 3/482; E05F 1/10; E05F 1/1025
(Continued)

(56) References Cited

U.S. PATENT DOCUMENTS 1,188,482 A * 6/1916 Phillips ..... E05D 15/165 16/104
3,610,167 A * 10/1971 Hasselmann ..... B66C 7/00 105/154
(Continued)

FOREIGN PATENT DOCUMENTS

AT 519902 * 11/2018
AT 521133 * 11/2019
(Continued)

OTHER PUBLICATIONS

International Search Report dated Apr. 9, 2018 in International (PCT) Application No. PCT/AT2017/060348.
(Continued)

*Primary Examiner* — Janet M Wilkens
(74) *Attorney, Agent, or Firm* — Wenderoth, Lind & Ponack, L.L.P.

(57) ABSTRACT

A guide system for guiding a movably mounted furniture part, in particular a folding or folding-sliding door, includes a longitudinal guide rail, at least one guide device via which the furniture part is movable in a longitudinal direction along the longitudinal guide rail, and at least one support on which the furniture part is mounted in an articulated manner. The at least one support is movable in a direction extending transversely to the longitudinal direction of the longitudinal guide rail, and the at least one support has a receiver for receiving the guide device and the support is movable in the mounted position into a transfer position in which the receiver is arranged adjacent to the longitudinal guide rail. A compensation device compensates for a height difference between the receiving device and the longitudinal guide rail is provided.

17 Claims, 5 Drawing Sheets

(51) Int. Cl.
*E05D 15/36* (2006.01)
*E05D 15/58* (2006.01)
*E06B 3/48* (2006.01)

(58) Field of Classification Search
USPC ..... 312/326, 329, 109, 322, 139.1, 138.1, 312/140, 313, 297; 49/254, 257, 259
See application file for complete search history.

(56) References Cited

U.S. PATENT DOCUMENTS

| | | | | |
|---|---|---|---|---|
| 8,303,056 | B2 | 11/2012 | Giorgi | |
| 8,484,895 | B2 * | 7/2013 | Kuhnmuench | E05D 15/48 49/149 |
| 9,068,386 | B2 | 6/2015 | Ishii et al. | |
| 9,284,761 | B2 | 3/2016 | Haab et al. | |
| 9,624,705 | B2 | 4/2017 | Haab et al. | |
| 10,227,806 | B2 | 3/2019 | Gabl | |
| 2010/0117500 | A1 | 5/2010 | Giorgi | |
| 2014/0150208 | A1 | 6/2014 | Haab et al. | |
| 2015/0008811 | A1 | 1/2015 | Ishii et al. | |
| 2016/0201368 | A1 | 7/2016 | Haab et al. | |
| 2017/0241178 | A1 | 8/2017 | Gabl | |
| 2017/0260789 | A1 | 9/2017 | Gabl | |
| 2018/0119470 | A1 | 5/2018 | Kohlweiss | |
| 2019/0301216 | A1 * | 10/2019 | Rupp | E05D 15/58 |
| 2019/0301218 | A1 * | 10/2019 | Rupp | E05D 15/58 |
| 2020/0018108 | A1 * | 1/2020 | Sperger | E05D 15/58 |

FOREIGN PATENT DOCUMENTS

| | | |
|---|---|---|
| AT | 521139 | * 11/2019 |
| CN | 101490355 | 7/2009 |
| CN | 103375100 | 10/2013 |
| CN | 104080992 | 10/2014 |
| DE | 298 09 193 | 10/1998 |
| EP | 2 740 870 | 6/2014 |
| JP | 57-60461 | 12/1982 |
| JP | 61-33811 | 10/1986 |
| JP | 2553098 | 7/1997 |
| TW | 526616 | 8/2016 |
| TW | 533117 | 12/2016 |
| WO | 2013/114730 | 8/2013 |
| WO | 2016/081961 | 6/2016 |
| WO | 2016/081963 | 6/2016 |
| WO | 2017/000006 | 1/2017 |
| WO | 2018204952 | * 11/2018 |

OTHER PUBLICATIONS

English translation of Search Report dated Dec. 20, 2018 in Taiwanese Application No. 107101171.
Search Report dated Nov. 14, 2017 in Austrian Application No. A 50024/2017, with English translation.

* cited by examiner

GUIDE SYSTEM FOR GUIDING A MOVABLY MOUNTED FURNITURE PART

BACKGROUND OF THE INVENTION

The invention concerns a guide system and an article of furniture having a guide system according to the invention.

Guide systems of the kind set forth in the opening part of this specification are already part of the state of the art and are disclosed for example in EP 2 740 870 A1. Such guide systems are capable of moving furniture parts arranged thereon, for example in the form of folding doors or folding-sliding doors, between an open position and a closed position, and compensating for a heightwise play occurring upon movement of an article of furniture. That heightwise play acts as a height difference between the moveable furniture part and the body of the article of furniture as soon as it moves from the closed position into an open position. That heightwise play is necessary, for example, in order to be able to adjust for example doors or sliding doors or leaf doors which are arranged moveably to the body of the article of furniture or the like, or to achieve higher degrees of freedom in regard to movement of the moveable furniture part. For example, moveable furniture parts must be able to move in the closed position into a body of an article of furniture without involving a collision and/or must also present a uniform gap formation in regard to other moveable furniture parts or the body of the article of furniture. Therefore, the moveable furniture parts in the closed position of the article of furniture (for example when all doors, folding doors or folding-sliding doors are closed) must be correctly positioned, which in the state of the art is effected by centering devices directly in the hinges. In the closed position so-to-speak the moveable furniture part is moved into the desired position by the hinge by way of those centering devices. In that case, the hinge cup arranged in the hinge has inclined centering surfaces which contact the arm of the hinge during the closing movement and thus center it or move it into the desired position without heightwise play. In that case, however, centering is effected by direct contact between the hinge arm and the hinge cup at comparatively small centering surfaces. The entire weight of the moveable hinge parts acts on those surfaces. After the furniture parts have been opened and closed a frequent number of times, problems can occur due to the small centering surfaces and the relatively high surface pressure on those small surfaces. Those problems are, for example, surface damage to the centering surfaces which can occur for example solely due to the friction between the arm and the centering surfaces and also due to the friction in combination with contamination like dust or metal abrasion particles. Such surface damage can subsequently result in limitations in the mobility or ease of movement of the hinge and as a further consequence, for example, when the hinge becomes jammed in its movement, it can also lead to damage to the entire article of furniture. In addition, the frictional contact of the centering surfaces can give rise to troublesome noise. With increasing wear of those surfaces, adjustment of the gap dimension also becomes increasingly poor.

SUMMARY OF THE INVENTION

The object of the invention is to avoid the above-described disadvantages and to provide a guide system which is improved over the state of the art and an article of furniture having such a guide system.

If the at least one support has a receiving device (receiver) for receiving the guide device and the support is moveable in the mounted position into a transfer position in which the receiving device is arranged adjacent to the longitudinal guide rail and there is provided a compensation device for compensating for a height difference between the receiving device and the longitudinal guide rail then the height difference or heightwise play is compensated by sturdy components and not by centering surfaces of small dimensions on a hinge cup. The force due to the weight of the moveable furniture part is distributed to a larger area and in addition does not have to be deflected by way of inclined surfaces, as is the case with the centering surfaces. In the case of the guide system according to the invention the main loading is transmitted to components which are already very sturdy and which have a load-bearing function and are not provided for the task of pivoting the moveable furniture part between two positions, as is the case with a cup-type hinge. In other words: lifting or compensating for the height difference is effected directly by way of load-bearing components of the guide system and not indirectly by way of the movement at the hinges. Those guide systems are provided by rails or profile members which by virtue of their intended function are of larger dimensions than for example hinges. Furthermore, those rails moveably carry a guide device which for example is mounted on rollers and can be more sturdy than a cup-type hinge. That structure for the entire guide system provides a longer service life, a higher level of stability, greater reliability and smooth-running movement with a low level of noise.

Further details and advantages of the present invention will be apparent from the features of the appendant claims.

BRIEF DESCRIPTION OF THE DRAWINGS

Further details and advantages of the present invention are described more fully hereinafter by means of the specific description of several embodiments by way of example illustrated in the drawings, in which.

DETAILED DESCRIPTION OF THE INVENTION

Figure 1A:
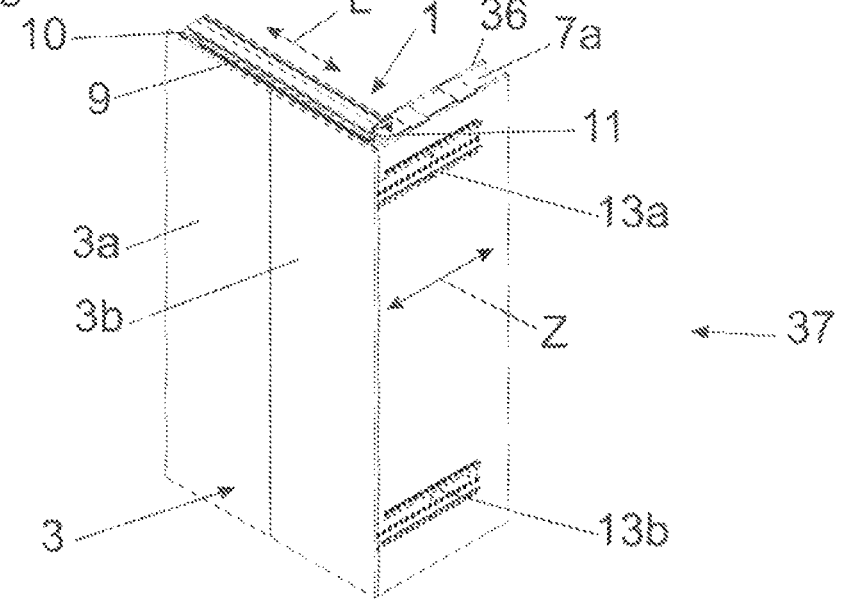
FIGS. 1*a*-1*c* show different positions of the moveable furniture part on the furniture body.

FIG. 1*a* shows a guide system 1 for guiding a moveably mounted furniture part 3, in particular a folding or folding-sliding door, including a longitudinal guide rail 9 arranged in the upper region of the article of furniture 37 and at least one guide device 10, by way of which the furniture part 3 is moveable in a longitudinal direction L, along the longitudinal guide rail 9.

Figure 1B:
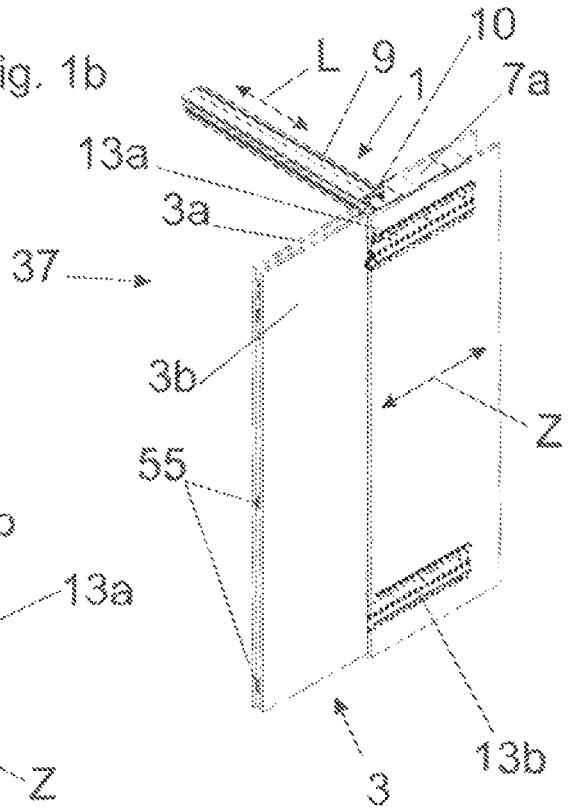

In addition the guide system 1 has a support 11 which is intended for receiving the guide device 10 as soon as it is moved into the open position of the door leaves 3*a*, 3*b* (see FIG. 1*b*). In addition, the furniture part 3 is mounted hingedly to the support 11 or in the region beneath the support by way of fitments 18 (see FIG. 6), wherein the support 11 is displaceable in a direction Z extending transversely relative to the longitudinal direction L of the longitudinal guide rail 9.

Figure 1C:
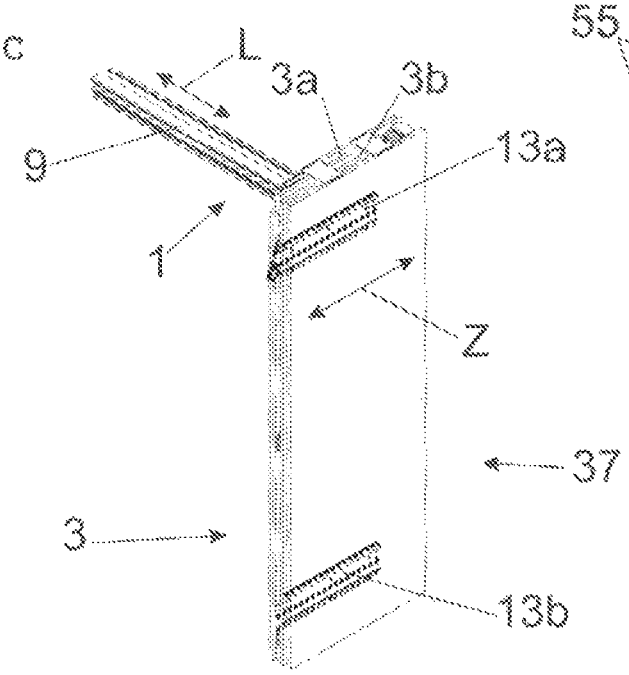

The article of furniture 37 has a furniture body or carcass 36 which is fixed in operation and at least two furniture parts 3 mounted moveably relative to the furniture body 36, in particular door leaves 3*a*, 3*b* of a folding or folding-sliding door. They are hingedly connected together in the mounted position by way of a vertically extending axis of rotation 5*a* (see FIG. 2). In that respect the at least two furniture parts 3 or in other words the door leaves 3*a*, 3*b* are moveable by the guide system 1 between a first position in which the door leaves 3*a*, 3*b* are oriented in substantially mutually coplanar relationship, and a second position in which the door leaves 3*a*, 3*b* are oriented in substantially mutually parallel relationship. The parallel orientation is shown in FIG. 1*c*.

FIG. 1*a* shows the closed position. FIG. 1*b* shows an open position and FIG. 1*c* shows an insertion position in which the at least one moveable furniture part 3 has been pushed into an insertion shaft 7*a*.

In FIG. 1*b* the furniture part 3, in this example afforded by two mutually moveable leaf doors 3*a*, 3*b*, has already been moved in a longitudinal direction L along the longitudinal guide rail 9 and is disposed in front of the insertion shaft 7*a*. In that case the door leaves 3*a*, 3*b* are arranged substantially or almost parallel to each other to find space in the insertion shaft 7*a*.

Figure 6:
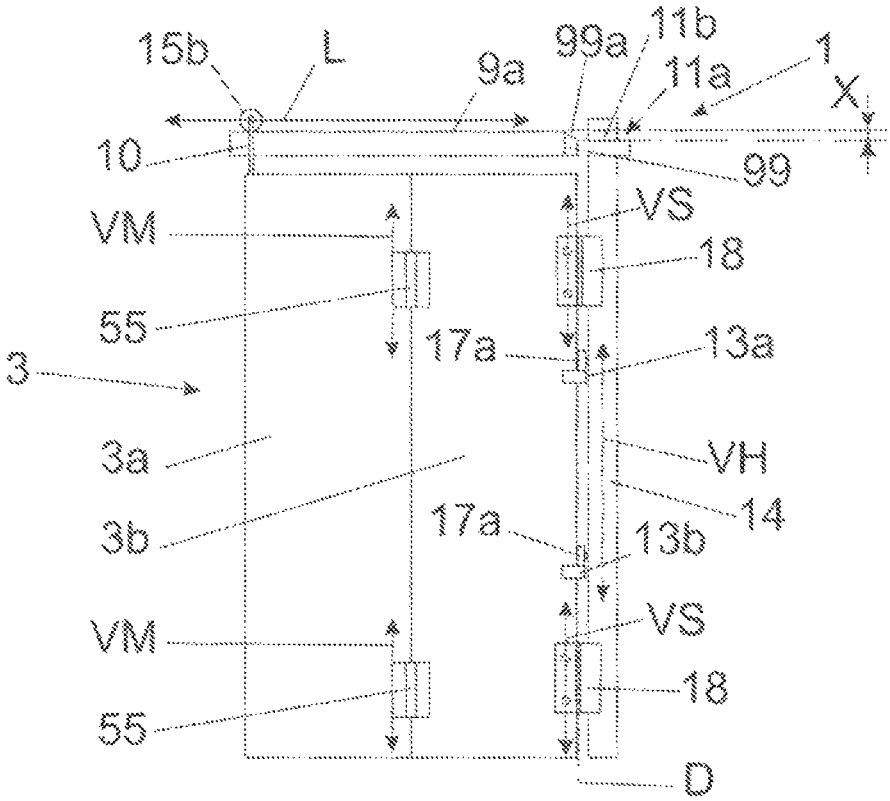
FIG. 6 is a diagrammatic view illustrating the guide system and moveable furniture parts.

The door leaf 3*b* or the furniture part 3 is in that case fixed at at least one fitment 18 moveably about an axis of rotation D at a column 14 (not visible). The column 14 is shown in FIG. 6.

The second door leaf 3*a* is mounted displaceably by means of a guide device 10 along the longitudinal guide rail 9. The furniture part 3, the two door leaves 3*a*, 3*b*, can be pushed out of the closed position shown in FIG. 1*b* into the insertion shaft 7*a*, as is shown in FIG. 1*c*. In that case the guide device 10 is received in the support 11. The guide device 10 therefore is no longer in contact with the longitudinal guide rail 9.

FIG. 1*c* shows how the furniture part 3 or the door leaves 3*a*, 3*b* have been pushed into the insertion shaft 7*a* by way of the insertion rails 13*b*. It is thus provided that the guide system 1 has at least one insertion rail 13*a*, 13*b*, along which the at least one support 11 or a column 14 arranged on the support is moveable in a direction Z extending transversely relative to the longitudinal direction L of the longitudinal guide rail 9. Thus, it is possible for the moveable furniture parts 3 to be stowed in space-saving fashion.

Figure 2:
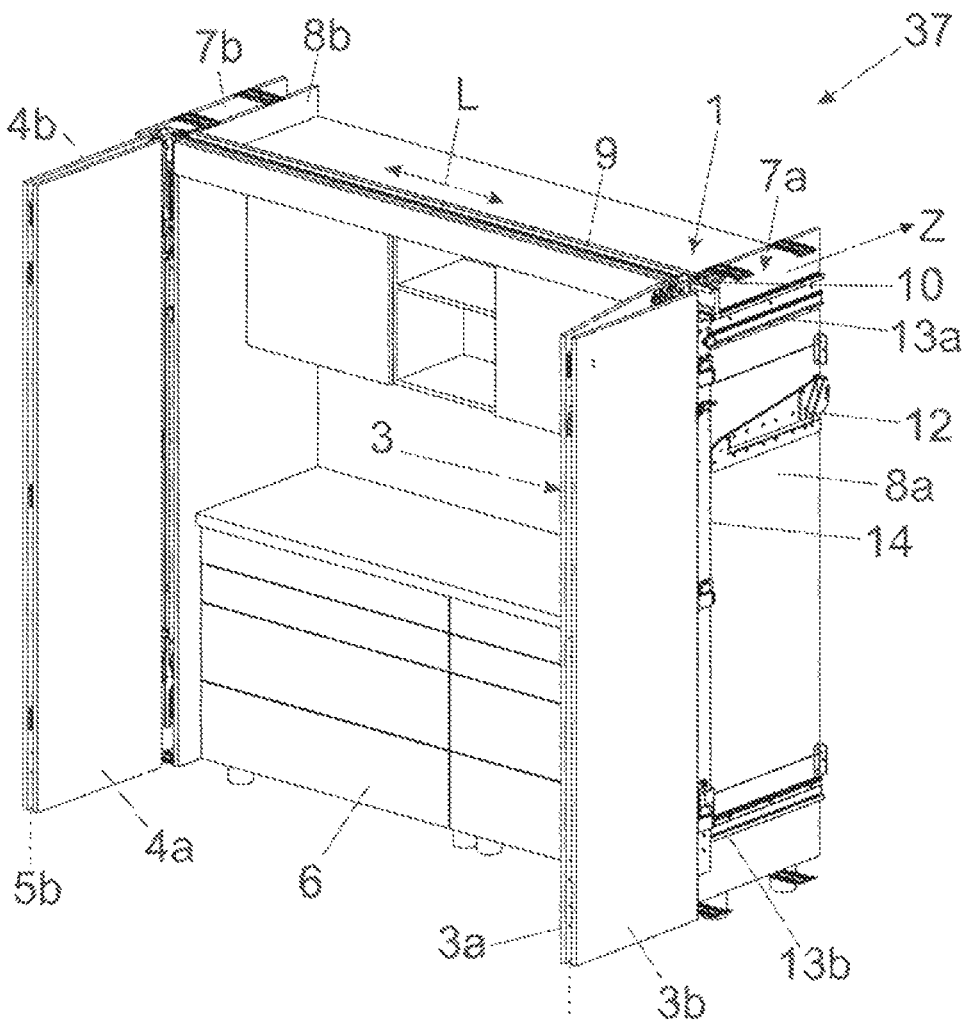
FIG. 2 shows an article of furniture with opened door leaves shortly before the transfer position.

FIG. 2 shows a possible application of a guide system 1 for guiding a furniture part 3, preferably in the form of a first door leaf 3*b* of a folding door or folding-sliding door, wherein the first door leaf 3*b* in the mounted position is connected to a second door leaf 3*a* by way of a vertically extending axis 5*a*. Optionally, there can also be provided at least two further door leaves 4*a*, 4*b* which are also pivotably connected together by way of a vertical extending axis 5*b*.

The guide system 1 can be used for example as a room divider system so that in a living space a furniture body 6 as shown in FIG. 2 in the form of a kitchen island, an office corner, a utility room, a shelf unit and so forth can be completely concealed by the door leaves 3*a*, 3*b*, 4*a*, 4*b* and can thus be visually separated from the remaining region of the living space.

The guide system 1, however, can also be used for cupboard systems like for example a walk-in wardrobe. The mode of operation is described hereinafter with reference to the door leaves 3*a* and 3*b*, in which respect the same configurations are applicable for the door leaves 4*a*, 4*b*.

The door leaves 3*a*, 3*b* are moveable by the guide system 1 between a first position in which the door leaves 3*a*, 3*b* are oriented substantially in mutually coplanar relationship and in that case conceal the furniture body 6, and a second position in which the door leaves 3*a*, 3*b* are oriented in substantially mutually parallel relationship. In that second position the furniture body 6 is accessible for a person, wherein the two door leaves 3*a*, 3*b* can be received in an insertion shaft 7*a* disposed laterally beside the side wall 8*a* in such a way as to save space (the left-hand insertion shaft 7*b* for the other door leaves 4*a*, 4*b* can be better clearly seen from the drawing).

The guide system 1 includes a longitudinal guide rail 9 having a longitudinal direction L for guiding the door leaves 3*a*, 3*b*. That longitudinal guide rail 9 can be secured for example to the ceiling of a room, a wall of a room, or also to a furniture body, preferably parallel to a front side of the latter.

Figure 3:
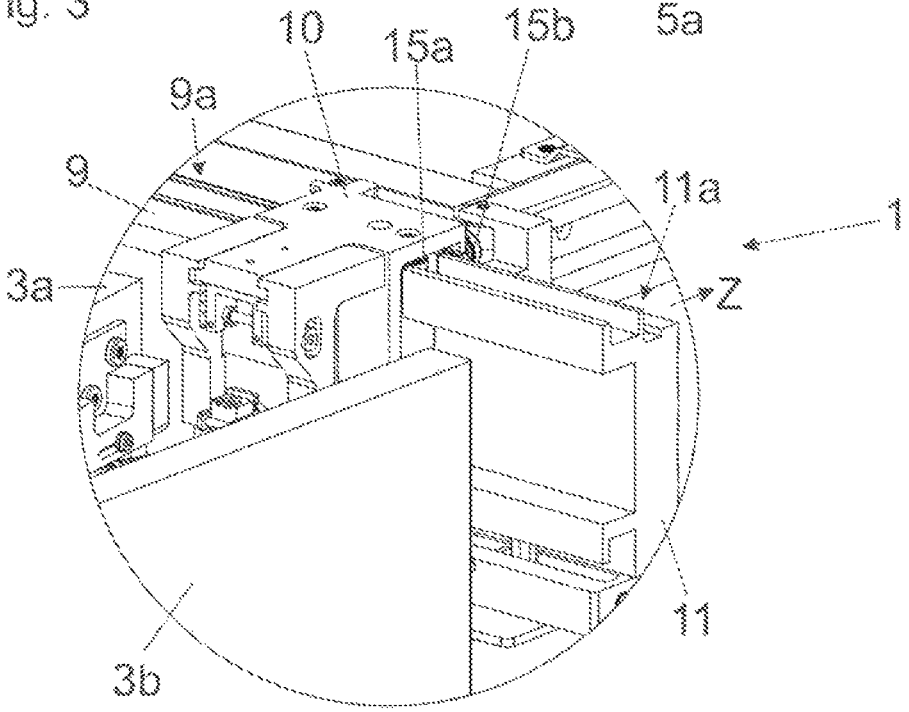
FIG. 3 is a detail view from FIG. 2.

FIG. 3 shows an enlarged view of the region of the guide device 10, that is shown in FIG. 2. The first door leaf 3*b* is connected to a guide device 10, by which the door leaves 3*a*, 3*b* are mounted moveably along the longitudinal guide rail 9. It is possible to see a support 11 which is separate from the longitudinal guide rail 9, being in the form of a displaceable carriage which in a transfer position in the longitudinal direction L adjoins the longitudinal guide rail 9 in such a way that the guide device 10 connected to the first door leaf 3*a* is transferable in a reciprocating manner between the longitudinal guide rail 9 and the support 11. The guide device 10 can have at least a first roller 15*a* with a vertical axis of rotation for receiving lateral forces and at least a second roller 15*b* with a horizontal axis of rotation for receiving vertical forces, wherein the rollers 15*a*, 15*b* are mounted moveably along a profile portion 9*a* of the longitudinal guide rail 9, the portion 9*a* extending in the longitudinal direction L. The support 11 also has a receiver 11*a* with a cross-section which corresponds to a shape and size of the profile portion 9*a* in respect of its cross-section so that the guide device 10 is transferable in a reciprocating manner between the longitudinal guide rail 9 and the support 11. The support 11 can for example have at least two guide channels 16*a*, 16*b* extending in the longitudinal direction L for guiding the rollers 15*a*, 15*b*.

The guide device 10 which is displaceable linearly along the longitudinal guide rail 9 is still on the longitudinal guide rail 9 in the illustrated transfer position of the support 11. The support 11 can be releasably locked to the longitudinal guide rail 9 in the transfer position, wherein that locking action can be released by the guide device 10 moving into or on to the support 11. After unlocking has occurred the support 11—together with the guide device 10 and the two door leaves 3*a*, 3*b*—is moveable in a horizontal direction, in a direction Z extending transversely, preferably at a right angle, relative to the longitudinal direction L of the longitudinal guide rail 9. The support 11 is connected to a vertically extending column 14 which is moveable in the direction Z and which is drivable at least portion-wise in the direction Z by a drive device 12. The column 14 is moveable in the direction Z along the second insertion rails 13*a* and 13*b* which in the mounted position are spaced from the longitudinal guide rail 9 in the heightwise direction.

Figure 4:
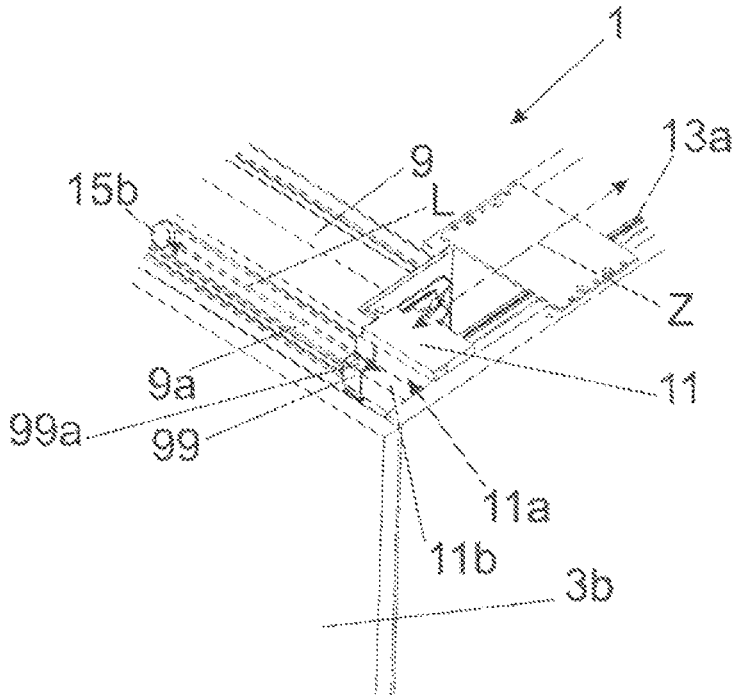
FIG. 4 is a simplified view of the guide system.

FIG. 4 shows the longitudinal guide rail 9 which provides a profile portion 9*a*. The at least one roller 15*b* is mounted moveably along same. The roller 15 is a component part of the guide device 10 (not visible in FIG. 4). A compensation device 99 is disposed at the end of the longitudinal guide rail 9. The compensation device 99 has a running surface 99*a*, along which the guide device 10 or a roller arranged on the guide device is displaceable.

The compensation device 99 is thus provided by a running surface 99*a* which is provided inclinedly relative to a profile portion 9*a* extending along the longitudinal guide rail 9. It can further be seen that the compensation device 99 is arranged in a region between the longitudinal guide rail 9 and the support 11 and/or the receiver 11*a*, and that the guide device 10 or its roller 15*b* can be reciprocatingly transferred (i.e., transferred in a reciprocating manner) between the longitudinal guide rail 9 and the receiver 11*a* by way of the compensation device 99.

The compensation device can also be provided in respect of a part thereof by the longitudinal guide rail 9 and in respect of a further part by the receiver 11*a*. It can be seen from FIG. 4 that the compensation device 99 is provided by a part of the receiver 11*a*. The receiver 11*a* is in turn a component part of the support 11.

Figure 5:
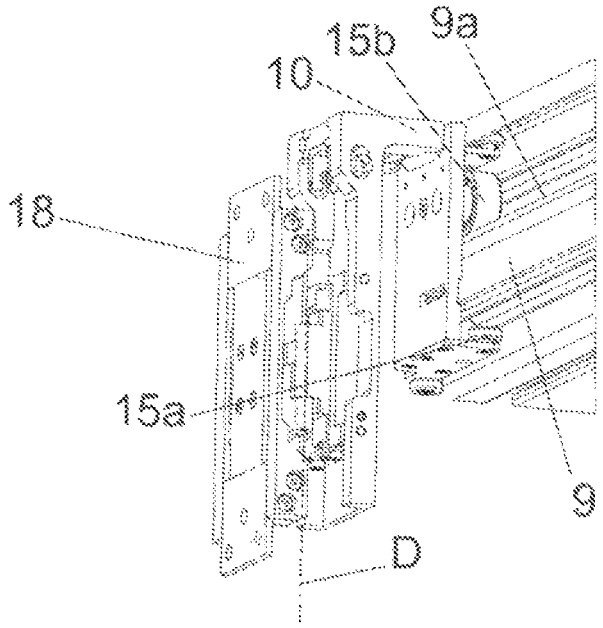
FIG. 5 shows the guide device on the longitudinal guide rail.

FIG. 5 shows the roller 15*b* which has a horizontal axis of rotation and which is mounted displaceably along the longitudinal guide rail 9 in the profile portion 9*a*. For stabilization purposes, the guide device 10 additionally has rollers 15*a* having a vertical axis of rotation. Arranged at the guide device 10 is a fitment 18 which is arranged moveably about the axis of rotation D and which is used to receive the furniture part 3. A furniture part arranged at that fitment 18 can thus be pivoted about the axis of rotation D and displaced along the longitudinal guide rail 9.

FIG. 6 shows a diagrammatic view illustrating the structure of the guide system 1 with the furniture part 3, in the form of the first door leaf 3*b* and the second door leaf 3*a*. The first door leaf 3*b* is arranged moveably on the column 14 by fitments 18. The second door leaf 3*a* is connected to the first door leaf 3*b* by way of central hinges 55. Disposed on the second door leaf 3*a* is the guide device 10 which is displaceable in the longitudinal direction L along the longitudinal guide rail 9. When the door leaves 3*a*,3*b* are pivoted relative to each other the guide device 10 moves along the longitudinal guide rail 9 on the profile portion 9*a*.

Disposed at the end of the longitudinal guide rail 9 and the profile portion 9*a* is the compensation device 99 which releases the roller 15*b* at the end of the longitudinal guide rail 9 and allows a certain heightwise play. That heightwise play or height difference X is compensated by the compensation device 99. Therefore, by virtue of the movement of the roller 15*b* thereonto, the compensation device 99 achieves a correct seat for the furniture part 3 in the closed position (as shown in FIG. 1*a*). The gap dimension between the furniture part 3 and for example the furniture body 37 is produced by way of passing over the compensation device 99 in the direction of the closed position. In the open position (FIG. 1*b*) or insertion position (FIG. 1*c*) that correct positioning of the furniture part 3 or the door leaves 3*a*, 3*b* in the correct heightwise position is no longer required. The furniture part 3 should have a little play in order to be able to be fitted or placed in the insertion shaft 7*a*.

The height difference X occurs due to the adjustability of the column 14 as shown by the arrow VH. In addition the furniture part 3 or the first door leaf 3*b* is also adjustable in its position by the fitment 18, which is shown by the arrow VS. The central hinge 55 for connecting the two door leaves 3*a*, 3*b* is also adjustable, which is shown by the arrow VM. Those differing adjustment options VM, VS and VH alter the height difference X and have to be compensated in the movement from the closed position into the open position. In that case the guide device 10 or the roller 15*b* arranged thereon, in the open position, can come into contact with the support 11 or the receiver 11*a* arranged thereon or can be positioned floating freely over same or in same.

It is therefore provided that the receiver 11*a* has a running surface 11*b*. The situation can occur where the at least one guide device 10, upon positioning in the receiver 11*a*, contacts the running surface 11*b* or is at a spacing relative to the running surface 11*b*. In the return movement into the closed position that height difference X has to be overcome by way of the compensation device 99. The guide device 10 or the at least one roller 15*b* arranged thereon can travel back on to the longitudinal guide rail 9 by way of the compensation device 99 which is in the form of an inclined profile portion 99*a* or ramp, in which case the correct heightwise position and thus the correct gap dimension is achieved.

In that respect, the compensation device 99 extends over a maximum of a third along the length of the receiver 11*a*, the receiver 11*a* being provided by the support 11.

It would also be possible for the compensation device 99 to be arranged on the longitudinal guide rail 9. It can also be seen that the compensation device 99 is provided by a ramp which extends in falling relationship from the longitudinal guide rail 9 in the direction of the receiver 11*a*.

The at least one roller 15*b* of the guide device 10 is thus reciprocatingly transferable between the longitudinal guide rail 9 and the receiver 11*a* by way of that compensation device 99. The support 11 and/or the receiver 11*a* is arranged at the top side of the vertically extending column 14, the furniture part 3 comprising the first and second door leaves 3*a*, 3*b* is secured moveably to the column 14 about the axis of rotation D by at least one fitment 18. In that arrangement the guide device 10 is connected to one of the door leaves 3*a*, 3*b* and provides for longitudinal guidance of the door leaves 3*a*, 3*b* in the pivotal movement from the open position into the closed position and vice-versa.

Another kind of compensation device 99 would be conceivable for example by means of a moveable flap or rocker mounted moveably between the two heightwise positions for compensating for the height difference X. Instead of a ramp which extends straight it is also possible to provide a curve.

Figure 7:
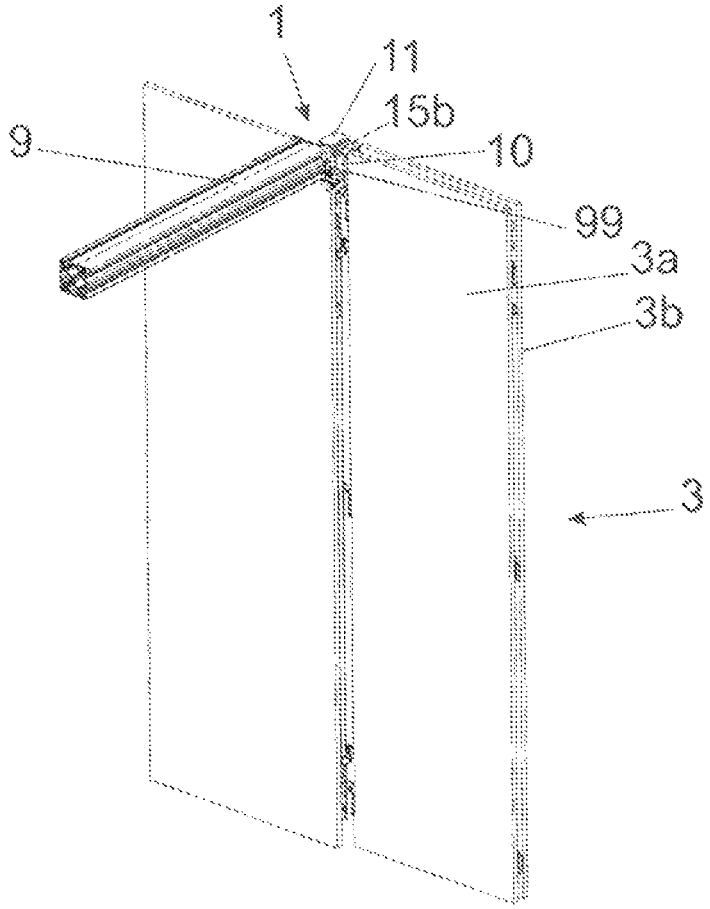
FIG. 7 shows the guide system with furniture parts set free.

FIG. 7 shows the door leaves 3*a*, 3*b* in an open position (as in FIG. 1*b*). In that arrangement the at least one roller 15*b* of the guide device 10 is arranged in the support 11, and the support 11 thus supports the moveable furniture part 3. Before that receiving situation the roller 15*b* is transferred from the longitudinal guide rail 9 into the receiver 11*a* of the support 11 by way of the compensation device 99.

Figure 8:
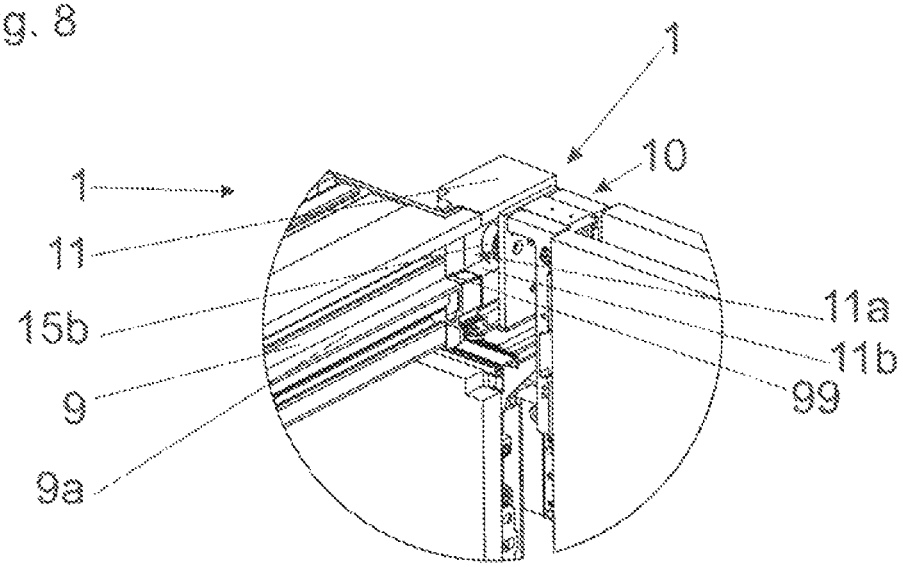
FIG. 8 is a detail view from FIG. 7.

FIG. 8 shows in detail how the roller 15*b* is received in the receiver 11*a*. If the furniture part 3 or the first and second door leaves 3*a*, 3*b*, as shown in FIG. 7, were moved from that open position into a closed position then the compensation device 99 which is in the form of a ramp, depending on the setting of the heightwise play X, would cause lifting movement of the at least one roller 15*b* or would compensate for the lifted position which has already been achieved by virtue of an adjustment. That affords collision-free return guidance of the guide device 10 out of the receiver 11*a* by way of the compensation device 99 on to the longitudinal guide rail 9 and the profile portion 9*a* thereof. The height difference X is compensated by the compensation device 99 in the form of a ramp. In addition the ramp affords a kind of insertion aid for the roller 15*b* and thus for the guide device 10 in passing from the profile portion 9*a* into the receiver 11*a*.

The invention claimed is:

1. A guide system for guiding a moveably mounted furniture part, the guide system comprising:

a longitudinal guide rail;

a guide device configured to allow the furniture part to move in a longitudinal direction along the longitudinal guide rail;

a support on which the furniture part is to be hingedly mounted, wherein the support is moveable in a direction extending transversely relative to the longitudinal direction of the longitudinal guide rail, the support having a receiver for receiving the guide device, and the support is moveable in a mounted position into a transfer position in which the receiver is arranged adjacent to the longitudinal guide rail; and a compensation device for compensating for a height difference between the receiver and the longitudinal guide rail.

2. The guide system according to claim 1, wherein the compensation device is arranged in a region between the longitudinal guide rail and the support and/or the receiver and the guide device is reciprocatingly transferable between the longitudinal guide rail and the receiver by the compensation device.

3. The guide system according to claim 1, wherein the compensation device comprises a running surface arranged at an incline relative to a profile portion extending along the longitudinal guide rail.

4. The guide system according to claim 1, wherein the compensation device is arranged on the support and/or on the longitudinal guide rail.

5. The guide system according to claim 1, wherein the compensation device comprises a part of the receiver.

6. The guide system according to claim 5, wherein the compensation device extends over a maximum of one-third of the length of the receiver.

7. The guide system according to claim 1, wherein the compensation device comprises a ramp extending in falling relationship from the longitudinal guide rail in a direction of the receiver.

8. The guide system according to claim 1, wherein the guide device has a roller, wherein the roller is reciprocatingly transferable between the longitudinal guide rail and the receiver by the compensation device.

9. The guide system according to claim 1, wherein the support and/or the receiver is arranged at the top side of a vertically extending column, wherein the furniture part is to be fixed to the column moveably about an axis of rotation by a fitment.

10. An article of furniture comprising:

a furniture part; and the guide system according to claim 1, wherein the furniture part comprises a first door leaf and a second door leaf, wherein the first door leaf and the second door leaf are connected together hingedly by a central hinge so that the furniture part is a folding-sliding door.

11. The guide system according to claim 1, wherein the receiver has a running surface and the guide device, upon positioning in the receiver, contacts the running surface or is spaced apart from the running surface.

12. The guide system according to claim 1, wherein the guide system has an insertion rail along which the support or a column arranged on the support is moveable in a direction extending transversely relative to the longitudinal direction of the longitudinal guide rail.

13. An article of furniture comprising the guide system according to claim 1.

14. The article of furniture according to claim 13, further comprising a furniture body fixed in operation, and at least two furniture parts mounted moveably relative to the furniture body, the at least two furniture parts being connected hingedly together in the mounted position by a vertically extending axis of rotation, wherein the at least two furniture parts are moveable by the guide system between a first position in which the furniture parts are oriented in a substantially mutually coplanar relationship, and a second position in which the furniture parts are oriented in a substantially mutually parallel relationship.

15. The article of furniture according to claim 14, further comprising a lateral insertion shaft in which the furniture parts are received in the second position.

16. The article of furniture according to claim 14, wherein the furniture body is a first furniture body, the article of furniture further comprising a second furniture body fitted into the first furniture body or connected to the first furniture body, wherein the second furniture body is concealed by the moveable furniture parts in the first position and is accessible in the second position.

17. The article of furniture according to claim 14, wherein the at least two furniture parts are door leaves of a folding door or a folding-sliding door.

* * * * *